US009835299B2

(12) United States Patent
Villalobos

(10) Patent No.: US 9,835,299 B2
(45) Date of Patent: Dec. 5, 2017

(54) HANDS FREE ILLUMINATION ASSEMBLY

(71) Applicant: Arturo Villalobos, Los Angeles, CA (US)

(72) Inventor: Arturo Villalobos, Los Angeles, CA (US)

( * ) Notice: Subject to any disclaimer, the term of this patent is extended or adjusted under 35 U.S.C. 154(b) by 119 days.

(21) Appl. No.: 14/921,479

(22) Filed: Oct. 23, 2015

(65) Prior Publication Data

US 2017/0114963 A1 Apr. 27, 2017

(51) Int. Cl.

| | |
|---|---|
| ***F21L 4/04*** | (2006.01) |
| ***A41D 13/01*** | (2006.01) |
| ***F21L 4/02*** | (2006.01) |
| ***F21V 7/00*** | (2006.01) |
| ***F21V 23/04*** | (2006.01) |
| *F21Y 101/00* | (2016.01) |

(52) U.S. Cl.

CPC ..... *F21L 4/02* (2013.01); *A41D 13/01* (2013.01); *F21V 7/00* (2013.01); *F21V 23/0414* (2013.01); *F21Y 2101/00* (2013.01)

(58) Field of Classification Search

CPC ..... F21L 4/02; F21L 4/027; F21L 4/04; F21Y 2113/00; F21Y 2115/00; F21Y 2113/13; A41D 13/01; F21V 21/145; F21V 33/0008

See application file for complete search history.

(56) References Cited

U.S. PATENT DOCUMENTS

| | | | | |
|---|---|---|---|---|
| 4,328,533 | A * | 5/1982 | Paredes | A41D 13/01 2/102 |
| 4,812,963 | A | 3/1989 | Albrecht et al. | |
| 4,967,323 | A * | 10/1990 | Johnson | F21L 4/045 362/103 |
| 5,070,436 | A * | 12/1991 | Alexander | A41D 13/01 340/321 |
| 5,779,348 | A | 7/1998 | Interlicchio | |
| D411,894 | S | 7/1999 | Rick | |
| 6,095,657 | A * | 8/2000 | Kent | F21L 15/02 362/108 |
| 6,106,130 | A | 8/2000 | Harding | |
| 6,877,875 | B2 * | 4/2005 | Yu | A42B 3/044 362/105 |
| 7,568,813 | B2 | 8/2009 | Barker | |
| 9,483,918 | B2 * | 11/2016 | Uriarte | G08B 5/004 |
| 2006/0176681 | A1 * | 8/2006 | Krimmer | A63B 69/0028 362/108 |
| 2007/0177376 | A1 | 8/2007 | Simoni | |
| 2010/0313328 | A1 | 12/2010 | Shelton et al. | |
| 2011/0038142 | A1 * | 2/2011 | Ritter | F21V 21/145 362/108 |

FOREIGN PATENT DOCUMENTS

| | | |
|---|---|---|
| WO | WO2006012928 | 2/2006 |

* cited by examiner

*Primary Examiner* — Peggy Neils

(57) ABSTRACT

A hands free illumination assembly includes a harness that may be worn. A plurality of flashlights is provided and each of the flashlights is movably coupled to the harness. Thus, each of the flashlights may illuminate an area when the harness is worn. Each of the flashlights is positionable at a selected angle with respect to the harness. Each of the flashlights may direct light onto a selected area.

7 Claims, 4 Drawing Sheets

HANDS FREE ILLUMINATION ASSEMBLY

BACKGROUND OF THE DISCLOSURE

Field of the Disclosure

The disclosure relates to illumination devices and more particularly pertains to a new illumination device for providing hands free illumination.

SUMMARY OF THE DISCLOSURE

An embodiment of the disclosure meets the needs presented above by generally comprising a harness that may be worn. A plurality of flashlights is provided and each of the flashlights is movably coupled to the harness. Thus, each of the flashlights may illuminate an area when the harness is worn. Each of the flashlights is positionable at a selected angle with respect to the harness. Each of the flashlights may direct light onto a selected area.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
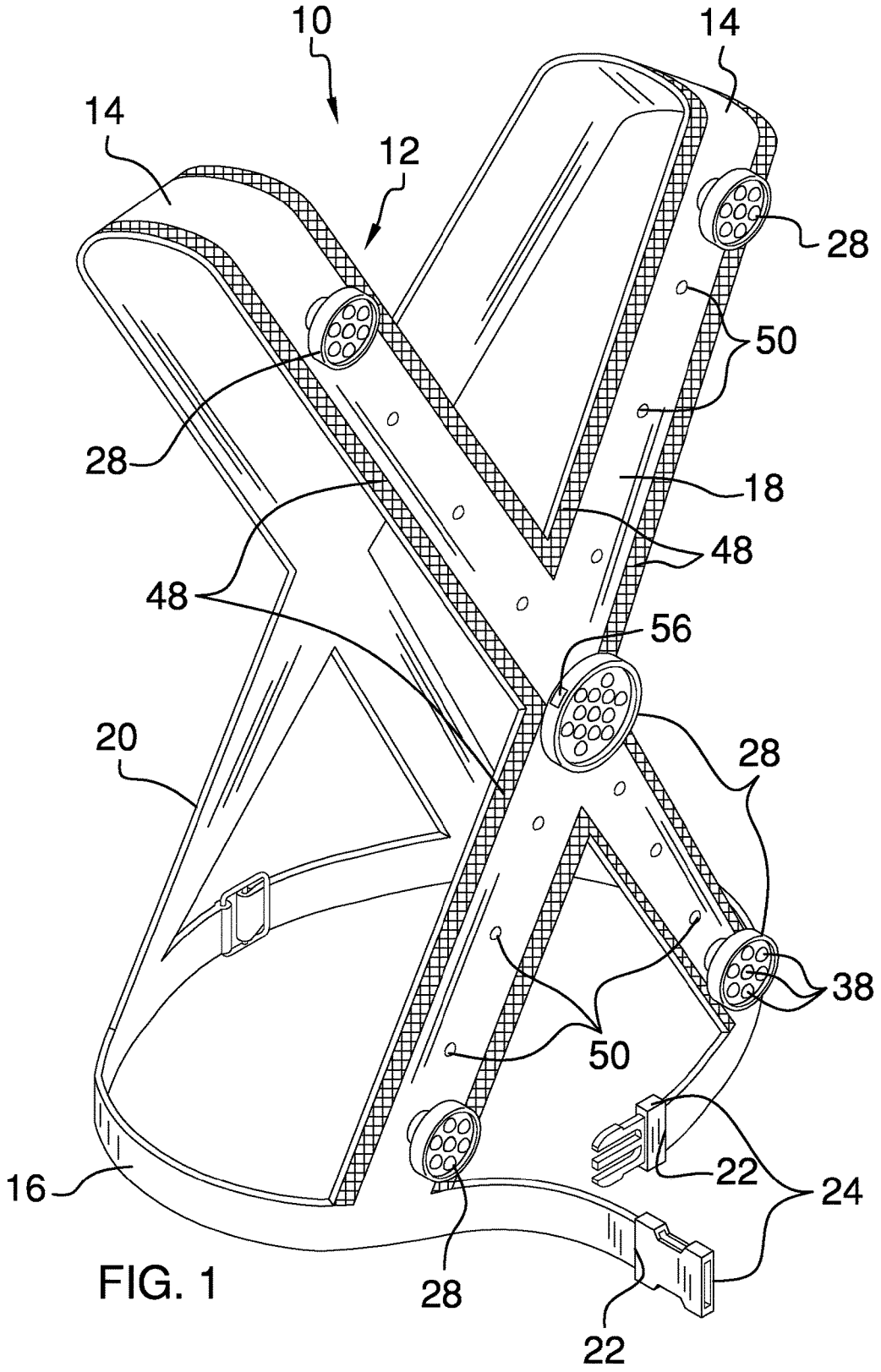
FIG. 1 is a front perspective view of a hands free illumination assembly according to an embodiment of the disclosure.
Figure 2:
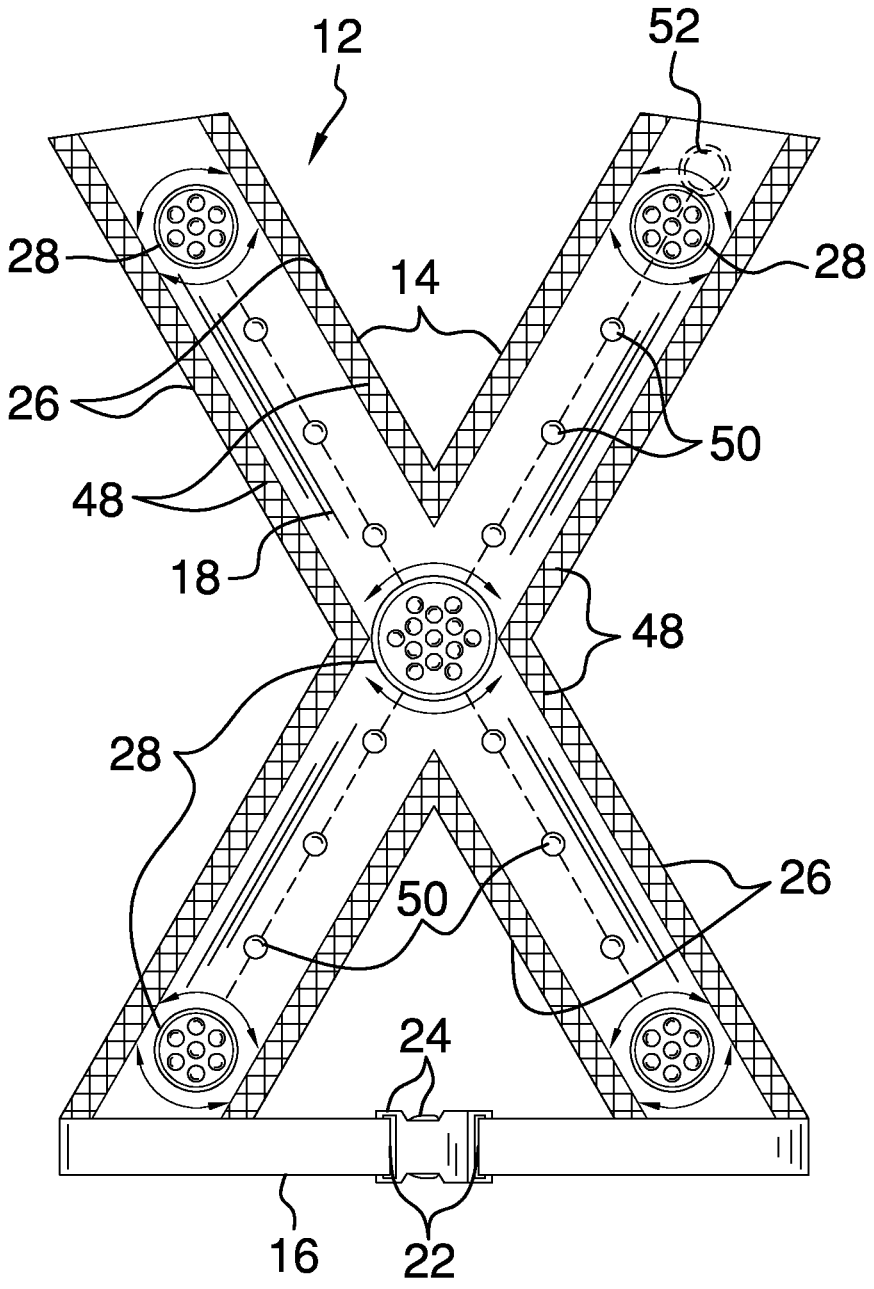
FIG. 2 is a front phantom view of an embodiment of the disclosure.
Figure 3:
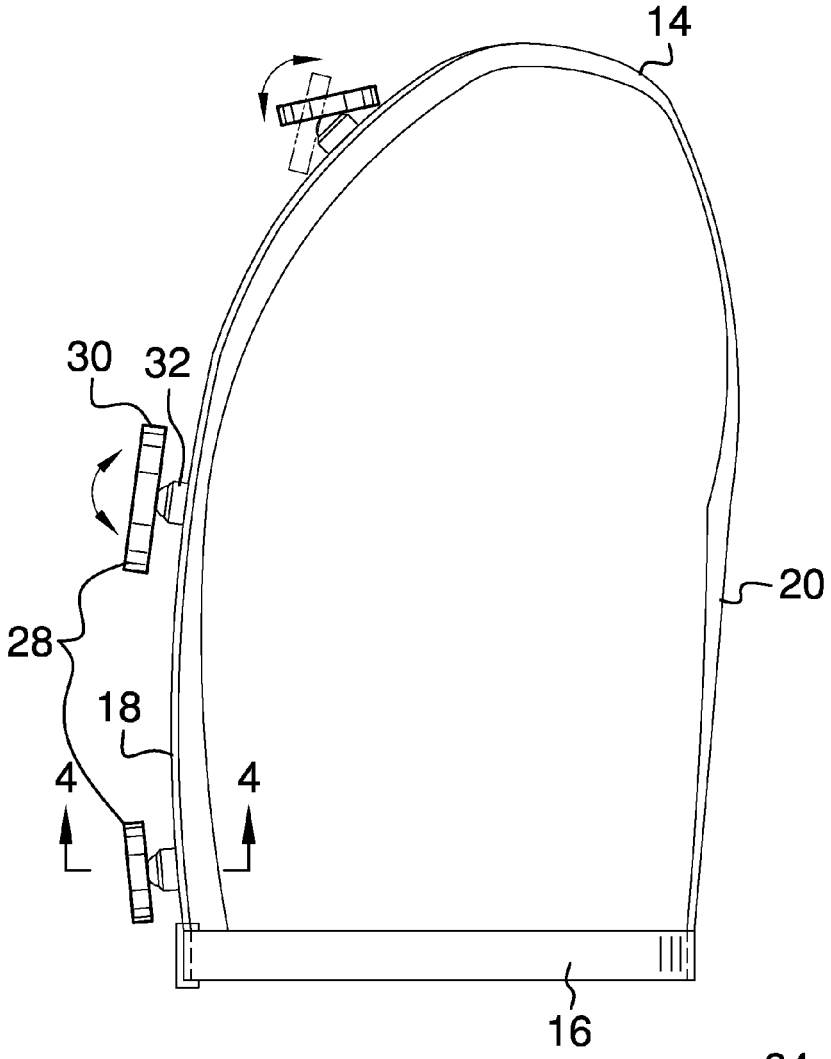
FIG. 3 is a left side view of an embodiment of the disclosure.
Figure 4:
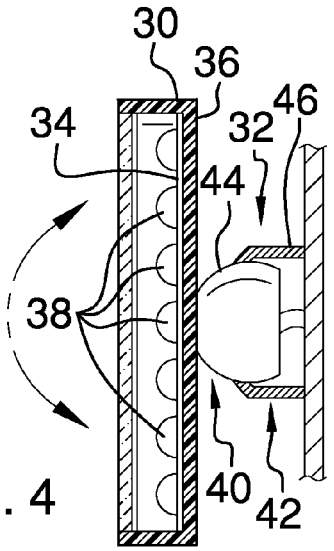
FIG. 4 is a cross sectional view taken along line 4-4 of FIG. 3 of an embodiment of the disclosure.
Figure 5:
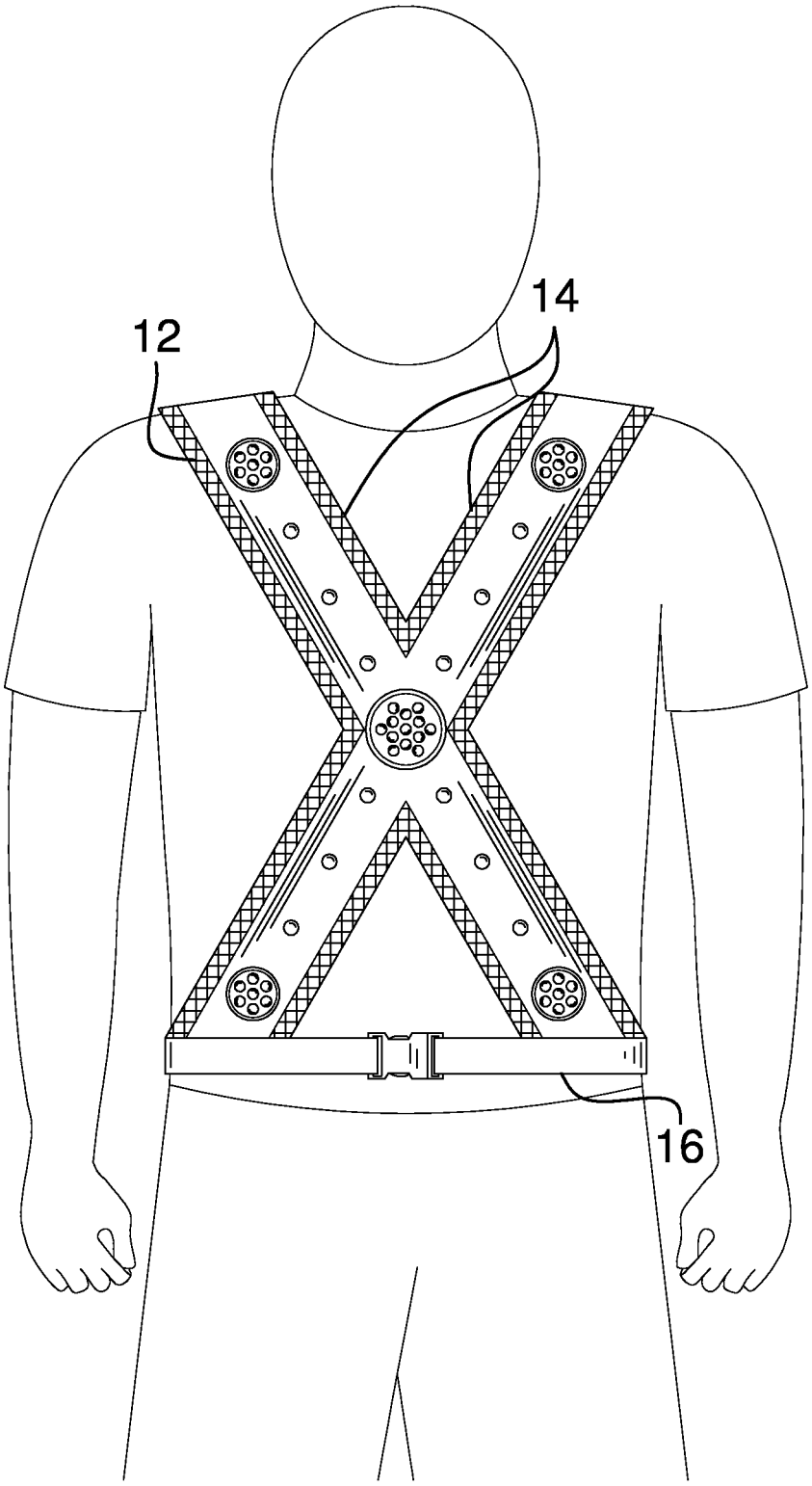
FIG. 5 is a perspective in-use view of an embodiment of the disclosure.

With reference now to the drawings, and in particular to FIGS. 1 through 5 thereof, a new illumination device embodying the principles and concepts of an embodiment of the disclosure and generally designated by the reference numeral 10 will be described.

As best illustrated in FIGS. 1 through 5, the hands free illumination assembly 10 generally comprises a harness 12 that may be worn. The harness 12 has a pair of shoulder straps 14 and a waist strap 16. The harness 12 has a front side 18 and a back side 20 and each of the shoulder straps 14 is coupled to and extends upwardly from the waist strap 16. Each of the shoulder straps 14 extends between the front side 18 and the back side 20 corresponding to the waist strap 16.

Thus, each of the shoulder straps 14 may be extended over shoulders when the harness 12 is worn having the waist strap 16 extending around a waist.

The waist strap 16 is split to define a pair of ends 22 of the waist strap 16. A pair of buckles 24 is provided and each of the buckles 24 is coupled to an associated one of the ends 22. The buckles 24 are matable with each other to retain the waist strap 16 around the waist. The shoulder straps 14 intersect each other such that the front side 18 and the back side 20 corresponding to the shoulder straps 14 forms an x. Each of the shoulder straps 14 has a pair of lateral edges 26.

A plurality of flashlights 28 is provided and each of the flashlights 28 is movably coupled to the harness 12. Thus, each of the flashlights 28 may illuminate an area when the harness 12 is worn. Each of the flashlights 28 is positionable at a selected angle with respect to the harness 12. Thus, each of the flashlights 28 may direct light onto a selected area.

Each of the flashlights 28 includes a housing 30 and a mount 32. The housing 30 has a forward side 34 and a rear side 36. The forward side 34 has a plurality of first light emitters 38 coupled thereto. Each of the first light emitters 34 selectively emits light outwardly from the forward side 34. Each of the first light emitters 38 may comprise an LED or the like.

The mount 30 has a first portion 40 and a second portion 42. The first portion 40 comprises a sphere 44 that is coupled to the rear side 36 of the housing 30. The second portion 42 comprises a cup 46 that is coupled to the front side 18 corresponding to the shoulder straps 14. The sphere 44 is rotatably positioned within the cup 46. Thus, the forward side 34 is positionable at a selected angle with respect to the front side 18 corresponding to the shoulders straps 14. The flashlights 28 are spaced apart from each other and distributed along the shoulder straps 14. Each of the flashlights 28 is electrically coupled together.

A plurality of reflective strips 48 is provided. Each of the reflective strips 48 is coupled to the shoulders straps 14. Each of the reflective strips 48 is comprised of a light reflecting material. Thus, each of the reflective strips 48 reflects light thereby enhancing visibility of the harness 12. The reflective strips 48 are coextensive with the lateral edges 26 of the shoulder straps 14.

A plurality of second light emitters 50 is provided. Each of the second light emitters 50 is coupled to the front side 18 corresponding to the shoulder straps 14. Thus, each of the second light emitters 50 may illuminate the area. The second light emitters 50 are spaced apart from each other and distributed along the shoulder straps 14. Each of the second light emitters 50 is electrically coupled between each of the flashlights 28 such that the second light emitters 50 forms a circuit with the flashlights 28. Each of the second light emitters 50 may comprise an LED or the like.

A power supply 52 is coupled an associated one of the shoulder straps 14. The power supply 52 is electrically coupled to each of the flashlights 28. The power supply 52 is electrically coupled to each of the second light emitters 50. The power supply 52 comprises at least one battery 54. A switch 56 is coupled to one of the flashlights 28 and the switch 56 may be manipulated. The switch 56 is electrically coupled to the power supply 52 such that the switch 56 turns the power supply 52 on and off.

In use, the harness 12 is worn when a task is to be performed in a low light environment. The switch 56 is manipulated to turn the power supply 52 on. Each of the first light emitters 38 and each of the second light emitters 50 emit light. Each of the flashlights 28 is manipulated to direct the light in a selected direction. Thus, the harness 12 provides hands free illumination directed to a selected location while the task is performed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hands free illumination assembly comprising:

a harness being configured to be worn, said harness having a pair of shoulder straps and a waist strap, said harness having a front side and a back side, each of said shoulder straps being coupled to and extending upwardly from said waist strap, each of said shoulder straps extending between said front side and said back side corresponding to said waist strap wherein each of said shoulder straps is configured to be extended over shoulders when said harness is worn having said waist strap extending around a waist;

a plurality of flashlights, each of said flashlights being movably coupled to said harness wherein each of said flashlights is configured to illuminate an area when said harness is worn, each of said flashlights being positionable at a selected angle with respect to said harness wherein each of said flashlights is configured to direct light onto a selected area, wherein each of said flashlights includes a housing and a mount, said housing having a forward side and a rear side, said forward side having a plurality of first light emitters being coupled thereto; and a plurality of second light emitters, each of said second light emitters being coupled to said front side corresponding to said shoulder straps wherein each of said second light emitters is configured to illuminate the area, said second light emitters being spaced apart from each other and distributed along said shoulder straps, each of said second light emitters being electrically coupled between each of said flashlights such that said second light emitters forms a circuit with said flashlights.

2. The assembly according to claim 1, wherein said waist strap is split to define a pair of ends of said waist strap, said ends being matable with each other, said shoulder straps intersecting each other such that said front side and said back side corresponding to said shoulder straps forms an x, each of said shoulder straps having a pair of lateral edges.

3. The assembly according to claim 1, wherein said mount has a first portion and a second portion, said first portion comprising a sphere being coupled to said rear side, said second portion comprising a cup being coupled to said front side corresponding to said shoulder straps.

4. The assembly according to claim 3, wherein said sphere is rotatably positioned within said cup such that said forward side is positionable at a selected angle with respect to said front side corresponding to said shoulders straps, said flashlights being spaced apart from each other and distributed along said shoulder straps, each of said flashlights being electrically coupled together.

5. The assembly according to claim 2, further comprising a plurality of reflective strips, each of said reflective strips being coupled to said shoulders straps wherein each of said reflective strips is configured to reflect light thereby enhancing visibility of said harness, said reflective strips being coextensive with said lateral edges of said shoulder straps.

6. The assembly according to claim 1, further comprising a power supply being coupled an associated one of said shoulder straps, said power supply being electrically coupled to each of said flashlights and each of said second light emitters, said power supply comprising at least one battery.

7. A hands free illumination assembly comprising:

a harness being configured to be worn, said harness having a pair of shoulder straps and a waist strap, said harness having a front side and a back side, each of said shoulder straps being coupled to and extending upwardly from said waist strap, each of said shoulder straps extending between said front side and said back side corresponding to said waist strap wherein each of said shoulder straps is configured to be extended over shoulders when said harness is worn having said waist strap extending around a waist, said waist strap being split to define a pair of ends of said waist strap, said ends being matable with each other, said shoulder straps intersecting each other such that said front side and said back side corresponding to said shoulder straps forms an x, each of said shoulder straps having a pair of lateral edges;

a plurality of flashlights, each of said flashlights being movably coupled to said harness wherein each of said flashlights is configured to illuminate an area when said harness is worn, each of said flashlights being positionable at a selected angle with respect to said harness wherein each of said flashlights is configured to direct light onto a selected area, each of said flashlights including a housing and a mount, said housing having a forward side and a rear side, said forward side having a plurality of first light emitters being coupled thereto, said mount having a first portion and a second portion, said first portion comprising a sphere being coupled to said rear side, said second portion comprising a cup being coupled to said front side corresponding to said shoulder straps, said sphere being rotatably positioned within said cup such that said forward side is positionable at a selected angle with respect to said front side corresponding to said shoulders straps, said flashlights being spaced apart from each other and distributed along said shoulder straps, each of said flashlights being electrically coupled together;

a plurality of reflective strips, each of said reflective strips being coupled to said shoulders straps wherein each of said reflective strips is configured to reflect light thereby enhancing visibility of said harness, said reflective strips being coextensive with said lateral edges of said shoulder straps;

a plurality of second light emitters, each of said second light emitters being coupled to said front side corresponding to said shoulder straps wherein each of said second light emitters is configured to illuminate the area, said second light emitters being spaced apart from each other and distributed along said shoulder straps, each of said second light emitters being electrically coupled between each of said flashlights such that said second light emitters forms a circuit with said flashlights; and a power supply being coupled an associated one of said shoulder straps, said power supply being electrically coupled to each of said flashlights and each of said second light emitters, said power supply comprising at least one battery.

* * * * *